US006752280B2

(12) United States Patent
Dye

(10) Patent No.: US 6,752,280 B2
(45) Date of Patent: Jun. 22, 2004

(54) COLLAPSIBLE DISPLAY SHELVING

(75) Inventor: Robert George Dye, Glen Ridge, NJ (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 10/141,438

(22) Filed: May 8, 2002

(65) Prior Publication Data

US 2003/0209507 A1 Nov. 13, 2003

(51) Int. Cl.[7] ..... A47F 5/00

(52) U.S. Cl. ..... 211/149; 248/174; 108/162; 211/72

(58) Field of Search ..... 211/149, 72, 150, 211/132.1; 248/174; 108/162

(56) References Cited

U.S. PATENT DOCUMENTS

| | | | | |
|---|---|---|---|---|
| 901,858 A | | 10/1908 | Williams | |
| 957,218 A | | 5/1910 | Klefeker | |
| 2,088,741 A | | 8/1937 | Hanson | 211/41 |
| 2,249,234 A | | 7/1941 | Srodulski | 312/42 |
| 2,502,693 A | | 4/1950 | Alton | 211/133 |
| 2,642,330 A | | 6/1953 | Armour | 312/257 |
| 3,045,835 A | | 7/1962 | Hawthorne et al. | 211/149 |
| 3,093,247 A | | 6/1963 | Erickson | 211/149 |
| 3,144,134 A | | 8/1964 | Frommgen | 211/126 |
| 3,307,767 A | | 3/1967 | Humphrey et al. | 229/27 |
| 3,494,479 A | | 2/1970 | Martin | 211/126 |
| 3,863,575 A | | 2/1975 | Kuns et al. | 108/111 |
| 3,987,737 A | * | 10/1976 | Smith | 211/149 X |
| 4,122,782 A | | 10/1978 | Coombs | 108/111 |
| 4,151,803 A | * | 5/1979 | Ferrera et al. | 248/174 X |
| 4,202,278 A | | 5/1980 | Wadenhed | 108/182 |
| 4,271,766 A | | 6/1981 | Schmiedeler | 108/111 |
| 4,311,100 A | | 1/1982 | Gardner et al. | 108/111 |
| 4,415,090 A | | 11/1983 | Bustos | 211/49 |
| 4,519,319 A | | 5/1985 | Howlett | 108/111 |
| 4,552,271 A | | 11/1985 | Kranz | 211/41 |
| 4,582,003 A | | 4/1986 | Valero | 108/111 |
| 4,723,664 A | | 2/1988 | Smith | 211/149 |
| 4,740,010 A | | 4/1988 | Moskovitz | 280/641 |
| 4,760,928 A | * | 8/1988 | Bustos | 211/150 X |
| 4,911,311 A | | 3/1990 | Nagai | 211/126 |
| 4,942,830 A | | 7/1990 | Macaluso et al. | 108/111 |
| 4,949,851 A | | 8/1990 | Shaffer | 211/149 |
| 5,193,466 A | * | 3/1993 | Eder | |
| 5,213,220 A | | 5/1993 | McBride | 211/132 |
| 5,230,423 A | | 7/1993 | Gellatly | 206/45.14 |

(List continued on next page.)

FOREIGN PATENT DOCUMENTS

| | | |
|---|---|---|
| DE | 33 41 335 A1 | 5/1985 |
| EP | 0 220 778 A1 | 5/1987 |
| FR | 1 350 885 | 12/1963 |
| GB | 530986 | 12/1940 |

OTHER PUBLICATIONS

Reference #1: Picture of articulated display shelving, at least as early as Feb. 25, 2001.

Reference #2: Boxed cards display set–up instructions, at least as early as Feb. 25, 2001.

*Primary Examiner*—Robert W. Gibson, Jr.
(74) *Attorney, Agent, or Firm*—Greenberg Traurig, P.C.

(57) ABSTRACT

A collapsible shelving display, preferably fabricated at least in part, from corrugated paperboard. Side wall assemblies are hingedly connected to a back wall to form a stand. The stand includes foldable shelf support members that are inserted into receptacles cut out of the inner panels of the side wall assemblies. Shelves are pivotably attached to the back wall, and swingable between positions substantially parallel to the back wall to positions oblique or perpendicular to the back wall.

18 Claims, 4 Drawing Sheets

U.S. PATENT DOCUMENTS

| | | | | |
|---|---|---|---|---|
| 5,253,769 | A | 10/1993 | Vlastakis | 211/126 |
| 5,273,169 | A | * 12/1993 | Maglione | 211/149 |
| 5,315,936 | A | 5/1994 | Smith | 108/165 |
| 5,316,156 | A | 5/1994 | Land et al. | 211/149 |
| 5,322,172 | A | 6/1994 | Maglione | 211/132 |
| 5,392,902 | A | 2/1995 | Vlastakis | 206/45 |
| 5,458,411 | A | 10/1995 | Moss | 312/259 |
| 5,522,574 | A | 6/1996 | Maglione | 248/174 |
| 5,669,683 | A | 9/1997 | Moss et al. | 312/259 |
| 5,692,714 | A | 12/1997 | Morrison | 248/174 |
| 5,706,959 | A | 1/1998 | Smith | 211/132 |
| 5,826,732 | A | 10/1998 | Ragsdale | 211/149 |
| 5,899,345 | A | 5/1999 | Fuller et al. | 211/132.1 |
| 5,984,120 | A | 11/1999 | Johnske | 211/132.1 |
| 6,068,140 | A | 5/2000 | Mangrum et al. | 211/132.1 |
| 6,098,820 | A | 8/2000 | Smith | 211/132.1 |
| 6,126,254 | A | 10/2000 | Maglione | 312/259 |
| 6,145,794 | A | 11/2000 | Smith | 248/121 |

* cited by examiner

COLLAPSIBLE DISPLAY SHELVING

BACKGROUND OF THE INVENTION

1. Field of the Invention

The present invention is directed to point of purchase display shelving structures, in particular point of purchase display shelving structures for small products, that may be packaged in individual cartons or boxes, and stacked in arrays. The present invention is directed in particular to such point of purchase display shelving structures that are fabricated from paper, paperboard, and corrugated paper and corrugated paperboard materials, and which are configured to be transported to their point of use in a collapsed, but otherwise substantially fully assembled configuration.

2. Prior Art

Point of purchase display shelving structures for small size goods are well known. Such shelving structures are often fabricated from metal or plastic, and are fabricated to be quickly set up and knocked down, in order to accommodate the needs of the particular business establishment, as well as the changing promotional events that prompt the use of the point of purchase display shelving.

However, such metal and/or plastic displays are typically very generic in shape, little more than open-topped or open-front bins in which the goods are piled or stacked. Furthermore, such metal and/or plastic displays can be relatively heavy and/or bulky, even in their broken down form, and can be relatively expensive to fabricate, especially since they are not always intended for multiple uses, and are discarded after only one use.

Point of purchase display shelving structures for small articles, that have been fabricated from paper, paperboard, and corrugated paper and corrugated paperboard are known. Such point-of-purchase display shelving structures have the advantage of typically being lighter in weight than comparable metal or plastic structures. In addition, such display shelving structures are typically less expensive to manufacture and ship. Furthermore, such display shelving structures are often more amenable to recycling than metal or plastic structures, once their function as a display shelving structure has been completed.

Point of purchase display shelving structures, fabricated from paper, paperboard and/or corrugated paperboard, are also known which are manufactured and shipped to the ultimate consumer/point of use in a collapsed, but otherwise fully assembled form, in order to permit the shelving structure to be shipped in a minimum amount of volume, for reduced shipping costs. However, such prior art collapsible display shelving structures often suffer from a reduced structural strength, in comparison to non-collapsible paper, paperboard and/or corrugated paperboard material, or metal or plastic structures.

As such, it would be desirable to provide a collapsible display shelving structure, fabricated from paper, paperboard and/or corrugated paperboard, that is provided with enhanced structural strength and robustness, while retaining an economical configuration that is also relatively easy to raise from its collapsed construction.

These and other desirable characteristics of the invention will become apparent in light of the present specification, including claims, and drawings.

SUMMARY OF THE INVENTION

The present invention is directed, in part, to a collapsible shelving display fabricated at least in part from at least one of paper, paperboard, or corrugated paperboard material. The collapsible shelving display, according to a preferred embodiment of the invention, comprises, in part, a stand. The stand includes a substantially planar back wall, having two opposed side edge regions. Two side wall assemblies are foldably connected to respective ones of the two opposed side edge regions of the back wall, each of the two side wall assemblies being movable between a position substantially perpendicular to the back wall and foldably attached thereto, and a position substantially parallel and juxtaposed to the back wall and foldably attached thereto. At least one foldable shelf support member distinct from the stand is connected to each of the two side wall assemblies. The at least one foldable shelf support member is articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are in said substantially parallel position and juxtaposed to the back wall. At least one shelf member is positionable over said shelf support member, for supporting an article.

The at least one foldable shelf support member is preferably removable and operably connectable to the two side wall assemblies.

The at least one foldable shelf support member preferably includes two foldable end panels operably configured for insertion into corresponding apertures in respective ones of the side wall assemblies.

The at least one shelf member is preferably pivotably attached to the back wall, and pivotable between a collapsed position substantially parallel and juxtaposed to the back wall and a supporting position not substantially parallel and juxtaposed to the back wall, such that a portion of the at least one shelf member rests atop a portion of the at least one foldable shelf support member, when the at least one foldable shelf support member is in the position extending substantially straight across from one side wall assembly to the other.

The at least one shelf member preferably includes a top panel, a bottom panel, and an attachment panel foldably connected to the top panel, and wherein the top panel is foldably connected and fixedly connected to the bottom panel.

In a preferred embodiment of the invention, each side wall assembly comprises an inner side panel foldably connected to an opposite one of the side edge regions of the back wall; an outer side panel hingedly connected to the inner side panel; a side reinforcement panel hingedly connected to the outer side panel for disposition between the inner and outer side panels upon articulation of the stand.

In an embodiment of the invention, at least one leading edge of each side wall assembly is inclined upon articulation of said stand. In such an embodiment, preferably, the back wall is inclined at an angle substantially parallel to an angle of incline of the leading edge of each side wall assembly, so that the separation between said back wall and said leading edges remains substantially constant.

The at least one foldable shelf support member preferably comprises a central panel, having two opposed diagonal edge regions; at least two intermediate panels, each having an end, foldably connected to respective ones of the two diagonal edge regions of the central panel; and at least two end panels foldably connected to respective ends of the intermediate panels, each end panel further being operably configured to be connected to a respective one of the side wall assemblies.

In a preferred embodiment of the invention, each said inner side panel includes at least one aperture through which a respective one of said end panels of the at least one foldable shelf support member may be inserted.

The collapsible shelving display, in a preferred embodiment of the invention, further comprises a signage riser, extending upwardly from the back wall. The signage riser preferably comprises at least two non-identical panels, wherein one panel includes at least one attachment portion, said at least two non-identical panels being foldably connected and juxtaposed in partially overlying relation to one another, so that the at least one attachment portion extends away from the overlying portions of the at least two non-identical panels.

Preferably, the stand is fabricated from a single blank of corrugated paperboard material.

In a preferred embodiment, each side wall assembly further includes a cover panel foldably connected to and emanating from an upper edge region of each outer side panel, for covering a gap between each respective outer side panel and its corresponding inner side panel upon articulation of said stand.

The at least one foldable shelf support member is preferably fabricated from corrugated paperboard material, and the corrugations are oriented such that the corrugations extend horizontally in both the central panel and each of the intermediate panels; and the corrugations extend vertically in each of the end panels upon reorientation of the end panels into juxtaposition with said side wall assemblies. Preferably, the shelf member is fabricated from corrugated paperboard material, and the corrugations are oriented such that the corrugations extend horizontally in the upper panel, bottom panel, and attachment panel.

Preferably, the corrugations of the corrugated paperboard material, in the planar back wall, the two side wall assemblies, and the end panels of the at least one foldable shelf support member, extend vertically and the corrugations of the shelf supports and shelves extend horizontally transversely from side to side.

Preferably, each side wall assembly includes a double fold line between each outer side panel and inner side panel combination to accommodate orientation of each side reinforcement panel therebetween.

DETAILED DESCRIPTION OF THE DRAWINGS

Figure 1:
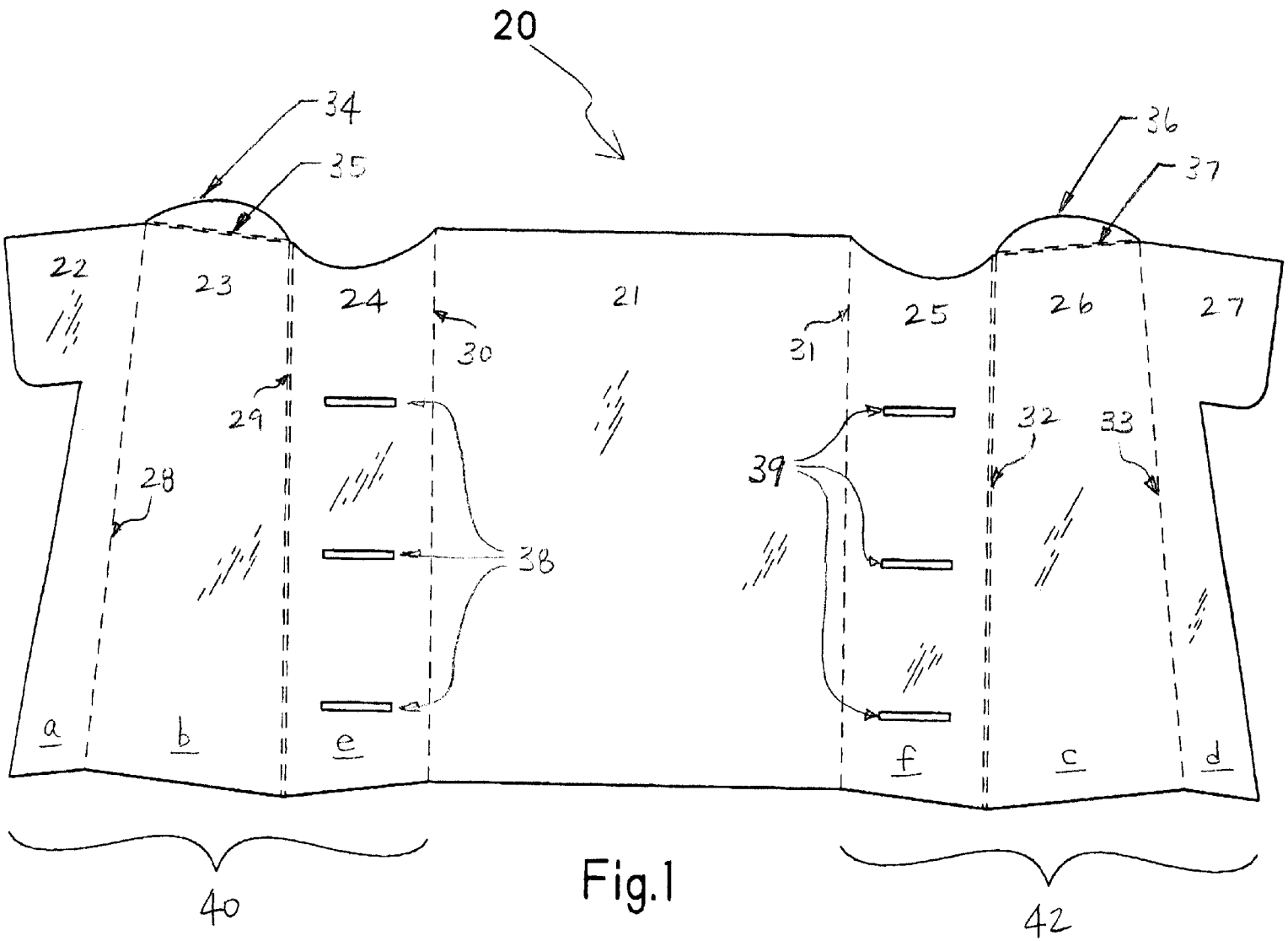
FIG. 1 is a plan view of the blank for the stand for the collapsible display shelving, according to a preferred embodiment of the invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated. In the figures, unless otherwise noted, the usual convention is observed that solid lines on the interior of a figure represents cuts, edges or points of inflection (like a ridge, crease or inwardly or outwardly projecting gusset), and broken or dashed lines indicate folds, score lines or other lines of weakness.

One version of the collapsible display shelving, according to a preferred embodiment of the invention is shown in FIGS. 1–8.

FIG. 1 is a plan view of blank 20 for the stand 10, for the collapsible display shelving, according to a preferred embodiment of the invention. In particular, blank 20 is viewed from its rear side in FIG. 1. Blank 20 includes back wall 21, side reinforcement panels 22 and 27, outer side panels 23 and 26, inner side panels 24 and 25, sector panels 34 and 36. The dashed lines marking the interior boundaries of the various panels, namely at 28, 29, 30, 31, 32, 33, refer to fold lines, scores, or other lines of weakness, which permits panels 22-23-24 and 25-26-27 to be folded upon themselves, as described herein in further detail.

The side reinforcement panels 22 and 27 emanate from the rear edges 28, 33 of outer side panels 23 and 26 respectively. Outer side panels 23 and 26 emanate from the rear edges 29, 32 of inner side panels 24 and 25, respectively. Inner side panels 24 and 25 emanate from the opposite side edge regions 30 and 31 of back wall 21.

Blank 20 also includes a plurality of apertures 38, 39 cut from the inner panels 24 and 25, representing the positions where shelf supports 90, and ultimately where shelves 100, may be mounted. While blank 20 is shown configured for providing locations for up to three shelf supports 90, a greater or lesser number of apertures 38, 39 may be provided, if desired, by altering blank 20 to accommodate a greater or lesser number of shelf supports 90.

To form stand 10, side reinforcement panels 22 and 27 are folded along fold lines 28 and 33, and attached (e.g., by any suitable adhesive) to outer side panels 23 and 26, so that surface a is against surface b, and surface c is against surface d.

Outer side panels 23 and 26 are folded about double fold lines 29 and 32, so that side reinforcement panels 22 and 27 are between outer side panels 23 and 26, and inner side panels 24 and 25, respectively, and adhered to surfaces e and f, respectively, to form side panel assemblies 40 and 42.

Side panel assemblies 40 and 42 are then folded perpendicular to back wall 21 (away from the observer, as seen in FIG. 1).

The function of sector panels 34 and 36 is to cover the gap between outer side panels 23 and 26 and inner side panels 24 and 25, and to provide a smooth top surface to each side panel assembly 40 and 42, so that the corrugation ends or sides at the edges of panels 23, 24, 25, and 26 are not exposed. The dashed lines marking the boundaries of the various panels, namely at 35, 37 refer to fold lines, scores, or other lines of weakness, which permits panels 34-23 and 36-26 to be folded upon themselves.

Figure 2:
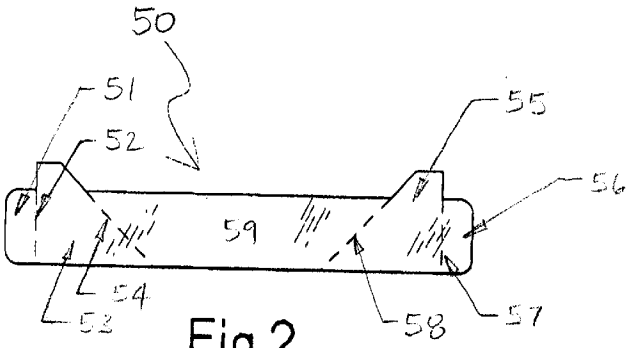
FIG. 2 is a plan view of the blank for the shelf support for the collapsible display shelving, according to the embodiment of FIG. 1.

FIG. 2 illustrates blank 50 for the shelf support 90, as viewed from the top. Blank 50 includes center panel 59, intermediate panels 53 and 55, and end panels 51 and 56. The dashed lines marking the boundaries of the various panels, namely at 52, 54, 57, and 58, refer to fold lines, scores, or other lines of weakness, which permit panels 51, 53, 59, 55 and 56 to be folded upon themselves. End panels 51 and 56 will be folded perpendicular (away from the observer, as seen in FIG. 2) to the center panel 59 to prepare each shelf support 90 for installation onto the stand 10.

Figure 3:
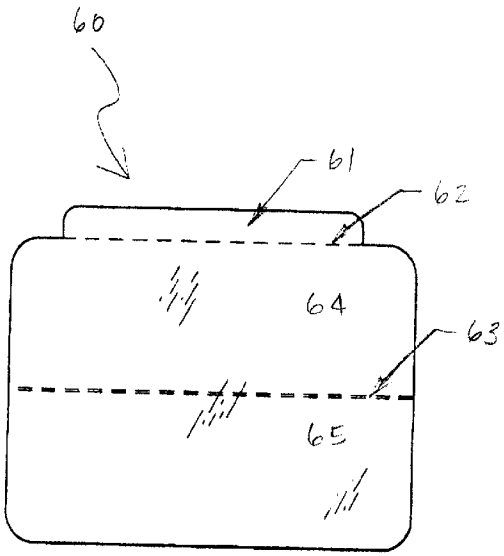
FIG. 3 is a plan view of the blank for the shelf for the stand for the collapsible display shelving, according to the embodiment of FIGS. 1 and 2.

FIG. 3 illustrates blank 60 for the shelf 100, as viewed from the top. Blank 60 includes mount panel 61, top panel 64, and bottom panel 65. The dashed lines marking the boundaries of the various panels, namely at 62 and 63, refer to fold lines, scores, or other lines of weakness, which permits panels 61, 64, and 65 to be folded upon themselves. Bottom panel 65 will be folded over and affixed, using a suitable adhesive, to top panel 64, leaving mount panel 61 exposed. Mount panel 61 will be folded perpendicular (away from the observer, as seen in FIG. 3) to the top panel 64 to prepare each shelf 100 for installation onto the stand 10.

Shelf supports 90 are installed onto the stand 10 by inserting each end panel 51, 56 into an appropriate aperture 38, 39 in the stand 10. Any suitable method, such as an adhesive, may be chosen to affix, permanently or semi-permanently, the end panels to the inner sides of the side panel assemblies 40 and 42. The end panels may be inserted either up or down or in any combination thereof. Furthermore, the side panel assemblies 40 and 42 need not include apertures 38 and 39 at all; rather, the end panels in any orientation may simply be permanently or semi-permanently affixed, using any suitable method, such as an adhesive, to the inner sides of the inner side panels 24 and 25 of side panel assemblies 40 and 42.

Shelf 100 is installed onto the stand 10 by placing a shelf 100 with the top panel 64 facing upward on top of a shelf support 90 such that the mount panel 61 comes in direct contact with the front face of the back wall 21. A suitable adhesive may then be used to permanently affix the mount member 61 to the front face of the back wall 21.

Figure 4:
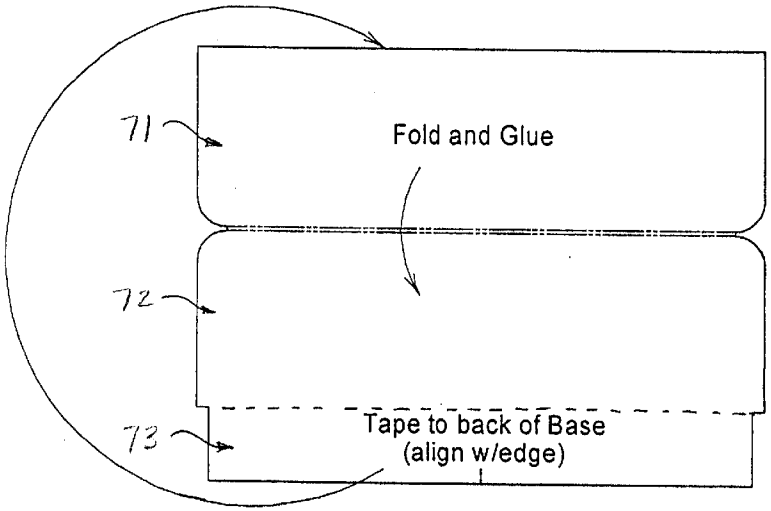
FIG. 4 is a plan view of the blank for the riser for the collapsible display shelving according to the embodiment of FIGS. 1–3, according to a preferred embodiment of the invention.

FIG. 4 illustrates blank 70, from which an optional riser 80 may be formed. The riser 80 may be used to attach advertising decals or other indicia. Front panel 71 will be folded over and affixed to rear panel 72, leaving attachment section 73 exposed, that may be juxtaposed to the back of the top edge region of back wall 21.

Figure 5:
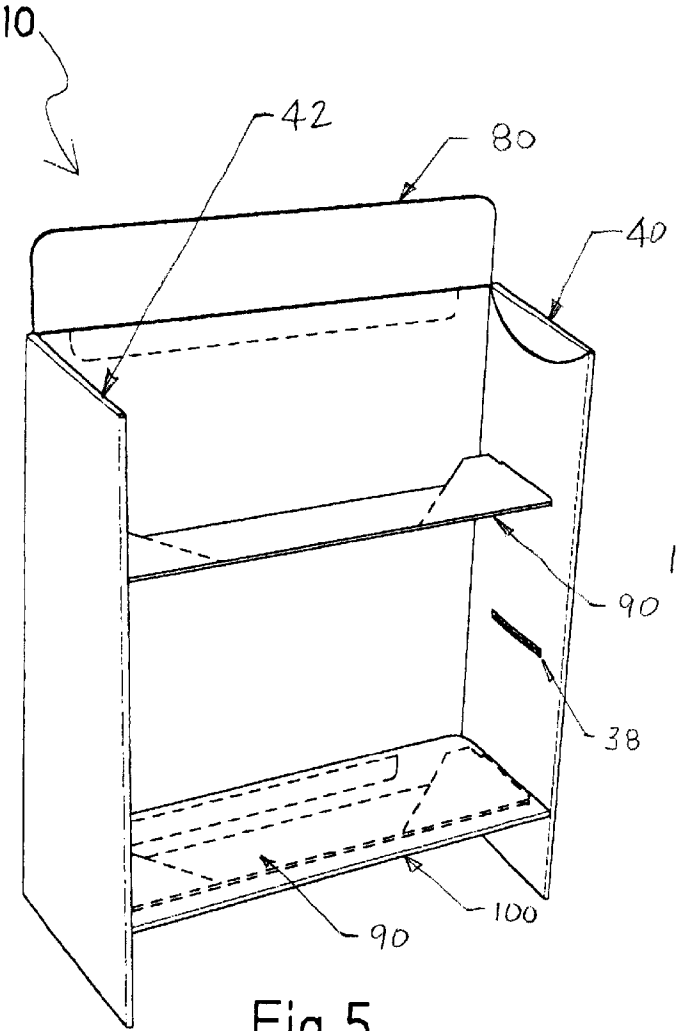
FIG. 5 is a perspective view of a partially assembled and articulated stand for the collapsible display shelving according to the embodiment of FIGS. 1–4 showing the placement of a shelf support as well as showing placement of shelf on top of a shelf support.

The resulting structure (with the optional riser) of stand 10 is shown from a front perspective view in FIG. 5. For purposes of visualization, only a shelf support 90 is shown installed in the top pair of shelf support apertures 38, 39 in stand 10, the middle pair of shelf support apertures 38, 39 are unused, and the bottom pair of shelf support apertures 38, 39 are shown with a shelf 100 resting on top of a shelf support 90. It should be noted that while three pairs of apertures 38, 39 are shown a lesser or greater number of pairs of apertures 38, 39 may be provided, as desired or required for a particular application.

Figure 6:
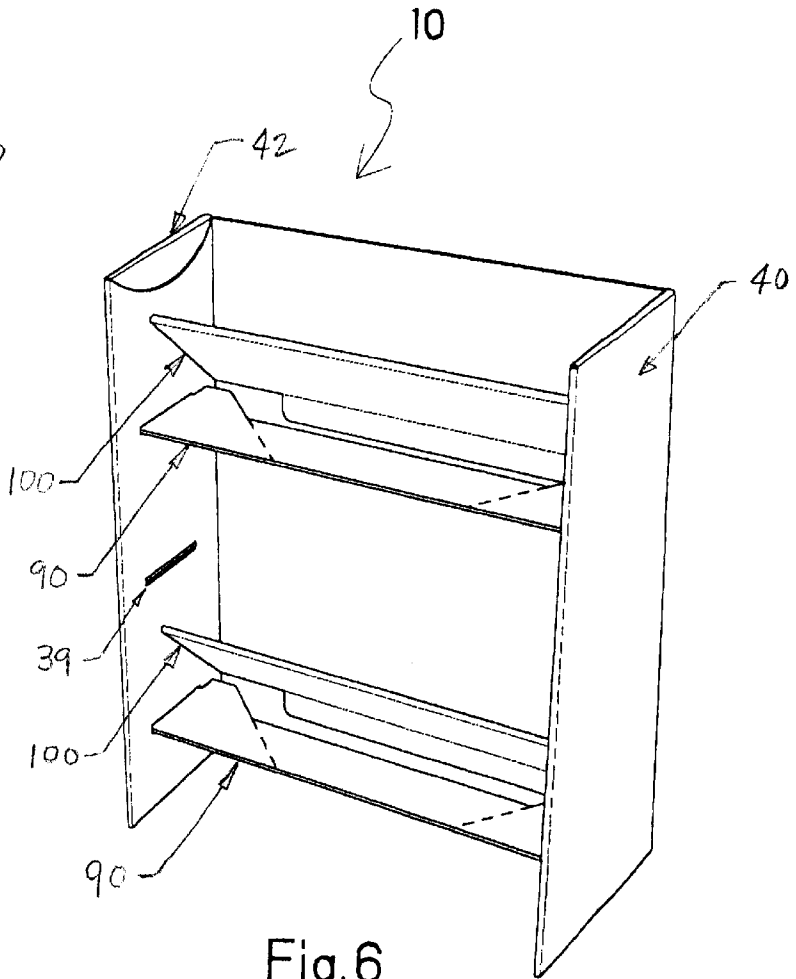
FIG. 6 is a perspective view of the collapsible display shelving according to the embodiment of FIGS. 1–5, with the shelves attached to the fully assembled and articulated stand, but with the shelves not fully positioned down upon the shelf support portions.

FIG. 6 is a perspective view of the collapsible display shelving according to the embodiment of FIGS. 1–5, with the shelves 100 attached to the fully assembled (with a total of 2 shelves) and articulated stand 10 (minus the optional riser 80), but with the shelves 100 not fully positioned down upon the shelf support members 90.

Figures 7, 8:
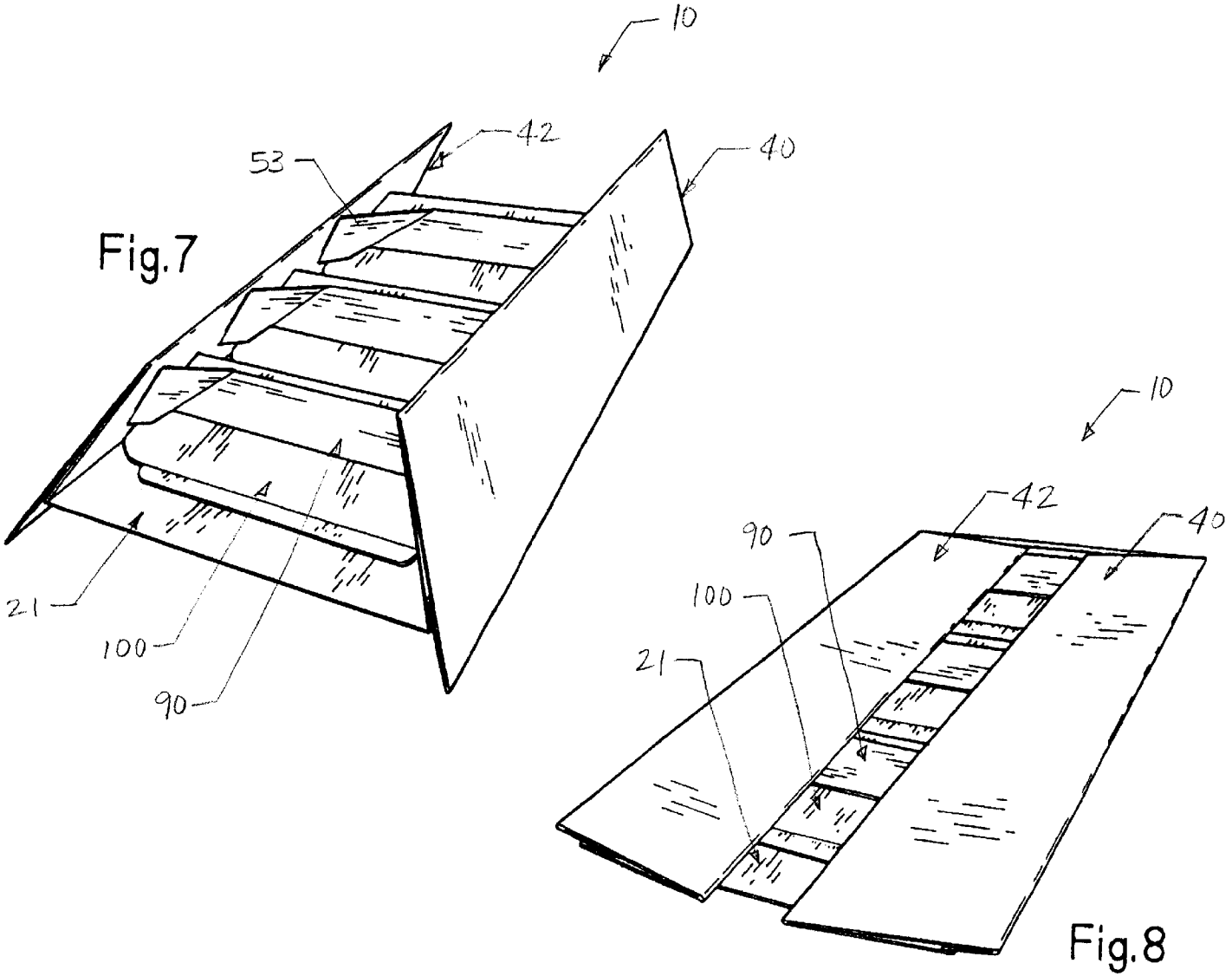
FIG. 7 is a bottom perspective view of the collapsible display shelving according to the embodiment of FIGS. 1–6, with the shelves folded up against the inside surface of the back wall, the shelf supports collapsed, and the sidewalls partially folded in toward one another and toward the inside surface of the back wall.
FIG. 8 is a bottom perspective view of the collapsible display shelving according to the embodiment of FIGS. 1–7, with the shelves folded up against the inside surface of the back wall, the shelf supports collapsed, and the sidewalls fully folded in toward one another and toward the inside surface of the back wall.

FIG. 7 is a bottom perspective view of the collapsible display shelving according to the embodiment of FIGS. 1–6 (minus the optional riser 80), with the shelves 100 folded up against the inside surface of the back wall 21, the shelf supports 90 collapsed, and the sidewall assemblies 40 and 42 partially folded in toward one another and toward the inside surface of the back wall 21. The process of collapsing collapsible display shelving 100 begins by pushing the shelves 100 upward, so that top panels 64 are juxtaposed parallel to the inner surface of back wall 21. Near simultaneously, side panel assemblies 40 and 42 are then folded inwardly towards one another thereby pushing shelf support center panels 59 upward. In this manner, intermediate panels 53 and 55 of each shelf support 90 will fold underneath upon the center panel of their respective shelf support 90.

FIG. 8 illustrates the result of continued motion of the side panel assemblies 40 and 42 toward one another eventually causing center panel 59, intermediate panels 53 and 55, shelves 100, and side wall assemblies 40 and 42 to become folded substantially coplanar with one another and substantially parallel to the inner surface of back wall 21.

In a preferred embodiment of the invention, when blank 20 is fabricated from corrugated paperboard material, the corrugations extend vertically from top to bottom, so that when fully erected and deployed, the vertically running corrugations provide enhanced strength to the shelf supports 90.

In an alternate embodiment of the invention, when blank 20 is fabricated from corrugated paperboard material, the corrugations are oriented in any direction when the stand is fully erected and deployed.

In a preferred embodiment of the invention, when blank 50 is fabricated from corrugated paperboard material, the corrugations extend horizontally from side to side, so that when fully erected and deployed, the horizontally running corrugations provide enhanced resistance to bending along the span of the shelf supports 90.

In an alternate embodiment of the invention, when blank 50 is fabricated from corrugated paperboard material, the corrugations of blank 50 extend in any direction necessary to achieve the intended strength of the shelf supports 90 when the stand is fully erected and deployed.

In a preferred embodiment of the invention, when blank 60 is fabricated from corrugated paperboard material, the corrugations extend horizontally from side to side, so that when fully erected and deployed, the horizontally running corrugations provide enhanced resistance to bending along the span of the shelves 100.

In an alternate embodiment of the invention, when blank 60 is fabricated from corrugated paperboard material, the corrugations of blank 60 extend in any direction necessary to achieve the intended strength of the shelves 100 when the stand is fully erected and deployed.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

I claim:

1. A collapsible shelving display fabricated at least in part from at least one of paper, paperboard, or corrugated paperboard material, the collapsible shelving display comprising;

a stand, said stand including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall and foldably attached thereto;

a plurality of foldable shelf support members, of at least one material from amongst paper, paperboard and corrugated paperboard, said plurality of shelf support members being distinct from said stand connected to each of the two side wall assemblies, each foldable shelf support member having at least one substantially rigid portion and being articulable, between a position extending substantially straight across from one side wall assembly to the other and spaced from the back wall when both side wall assemblies are substantially perpendicular to the back wall, and a collapsed position wherein portions of each shelf support member are folded over upon other portions of that shelf support member and substantially juxtaposed against the back wall, when both side wall assemblies are in said substantially parallel position and juxtaposed to the back wall; and a shelf member positionable over each said shelf support member, for supporting an article.

2. The collapsible shelving display according to claim 1, wherein said at least one foldable shelf support member is removable and operably connectable to the two side wall assemblies.

3. A collapsible shelving display fabricated at least in part from at least one of paper, paperboard, or corrugated paperboard material, the collapsible shelving display comprising;

a stand, said stand including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall and foldably attached thereto;

at least one foldable shelf support member distinct from said stand connected to each of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are in said substantially parallel position and juxtaposed to the back wall; and at least one shelf member positionable over said shelf support member, for supporting an article;

the at least one foldable shelf support member being removable and operably connectable to the two side wall assemblies;

wherein said at least one foldable shelf support member includes two foldable end panels operably configured for insertion into corresponding apertures in respective ones of the side wall assemblies.

4. The collapsible shelving display according to claim 1, wherein said at least one shelf member is pivotably attached to the back wall, and pivotable between a collapsed position substantially parallel and juxtaposed to the back wall and a supporting position not substantially parallel and juxtaposed to the back wall, such that a portion of the at least one shelf member rests atop a portion of the at least one foldable shelf support member, when the at least one foldable shelf support member is in the position extending substantially straight across from one side wall assembly to the other.

5. The collapsible shelving display according to claim 1, wherein said at least one shelf member includes a top panel, a bottom panel, and an attachment panel foldably connected to the top panel, and wherein the top panel is foldably connected and fixedly connected to the bottom panel.

6. The collapsible shelving display according to claim 1, wherein each side wall assembly comprises:

an inner side panel foldably connected to an opposite one of the side edge regions of the back wall;

an outer side panel hingedly connected to the inner side panel;

a side reinforcement panel hingedly connected to the outer side panel for disposition between the inner and outer side panels upon articulation of the stand.

7. The collapsible shelving display according to claim 6, wherein at least one leading edge of each side wall assembly is inclined upon articulation of said stand.

8. The collapsible shelving display according to claim 7, wherein said back wall is inclined at an angle substantially parallel to an angle of incline of the leading edge of each side wall assembly, so that the separation between said back wall and said leading edges remains substantially constant.

9. A collapsible shelving display fabricated at least in part from at least one of paper, paperboard, or corrugated paperboard material, the collapsible shelving display comprising;

a stand, said stand including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall and foldably attached thereto;

at least one foldable shelf support member distinct from said stand connected to each of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are in said substantially parallel position and juxtaposed to the back wall; and at least one shelf member positionable over said shelf support member, for supporting an article; and wherein the at least one foldable shelf support member comprises:

a central panel, having two opposed diagonal edge regions;

at least two intermediate panels, each having an end, foldably connected to respective ones of the two diagonal edge regions of the central panel; and at least two end panels foldably connected to respective ends of the intermediate panels, each end panel further being operably configured to be connected to a respective one of the side wall assemblies.

10. The collapsible shelving display according to claim 9, in which each said inner side panel includes at least one aperture through which a respective one of said end panels of the at least one foldable shelf support member may be inserted.

11. The collapsible shelving display according to claim 1, further comprising a signage riser, extending upwardly from the back wall.

12. A collapsible shelving display fabricated at least in part from at least one of paper, paperboard, or corrugated paperboard material, the collapsible shelving display comprising;

a stand, said stand including a substantially planar back wall, having two opposed side edge regions, two side wall assemblies foldably connected to respective ones of the two opposed side edge regions of the back wall, each of the two side wall assemblies being movable between a position substantially perpendicular to the back wall and foldably attached thereto, and a position substantially parallel and juxtaposed to the back wall and foldably attached thereto;

at least one foldable shelf support member distinct from said stand connected to each of the two side wall assemblies, the at least one foldable shelf support member being articulable, between a position extending substantially straight across from one side wall assembly to the other and spaced from the back wall when both side wall assemblies are substantially perpendicular to the back wall, and a collapsed position wherein portions of the at least one shelf support member are folded over upon other portions of the shelf support member and substantially juxtaposed against the back wall, when both side wall assemblies are in said substantially parallel position and juxtaposed to the back wall;

at least one shelf member positionable over said shelf support member, for supporting an article; and a signage riser, extending upwardly from the back wall;

wherein said signage riser comprises at least two non-identical panels, wherein one panel includes at least one attachment portion, said at least two non-identical panels being foldably connected and juxtaposed in partially overlying relation to one another, so that the at least one attachment portion extends away from the overlying portions of the at least two non-identical panels.

13. The collapsible shelving display according to claim 1, wherein the stand is fabricated from a single blank of corrugated paperboard material.

14. The collapsible shelving display according to claim 6, wherein each side wall assembly further includes a cover panel foldably connected to and emanating from an upper edge region of each outer side panel, for covering a gap between each respective outer side panel and its corresponding inner side panel upon articulation of said stand.

15. The collapsible shelving display according to claim 9, wherein the at least one foldable shelf support member is fabricated from corrugated paperboard material, and the corrugations are oriented such that;

the corrugations extend horizontally in both the central panel and each of the intermediate panels; and the corrugations extend vertically in each of the end panels upon reorientation of the end panels into juxtaposition with said side wall assemblies.

16. The collapsible shelving display according to claim 5, wherein the shelf member is fabricated from corrugated paperboard material, and the corrugations are oriented such that the corrugations extend horizontally in the upper panel, bottom panel, and attachment panel.

17. The collapsible shelving display according to claim 1, wherein the corrugations of the corrugated paperboard material, in the planar back wall, the two side wall assemblies, and the end panels of the at least one foldable shelf support member, extend vertically and the corrugations of the shelf supports and shelves extend horizontally transversely from side to side.

18. The collapsible shelving display according to claim 6, wherein each side wall assembly includes a double fold line between each outer side panel and inner side panel combination to accommodate orientation of each side reinforcement panel therebetween.

* * * * *